United States Patent [19]

Cowell

[11] 4,295,601

[45] Oct. 20, 1981

[54] CENTRIFUGE TUBE HOLDER

[75] Inventor: Mark J. Cowell, Mountain View, Calif.

[73] Assignee: Beckman Instruments, Inc., Fullerton, Calif.

[21] Appl. No.: 93,725

[22] Filed: Nov. 13, 1979

[51] Int. Cl.[3] ..... B04B 15/00

[52] U.S. Cl. ..... 233/26; 211/74; 366/214

[58] Field of Search ..... 233/26, 23 A, 1 R; 211/74, 76, 77; 366/213, 214

[56] References Cited

U.S. PATENT DOCUMENTS

| | | | |
|---|---|---|---|
| 3,454,217 | 7/1969 | Harbott | 233/26 |
| 3,666,171 | 5/1972 | Ellz | 233/26 |
| 3,674,198 | 7/1972 | Eberle | 233/26 |
| 3,891,140 | 6/1975 | Ayres | 233/26 |
| 4,135,660 | 1/1979 | Conn | 233/26 |

*Primary Examiner*—Robert W. Jenkins

*Attorney, Agent, or Firm*—R. J. Steinmeyer; F. L. Mehlhoff; William H. May

[57] ABSTRACT

A centrifuge tube holder which not only provides support for the tubes in a vertical orientation when placed on a workbench, but also horizontal and radial support when the tubes are placed in a centrifuge rotor. The tube holder has at least two sections which are pivotally connected to allow for upright or vertical orientation of the tubes when placed on a workbench. The two sections can be pivotally oriented with respect to each other to place the tubes horizontally in a centrifuge rotor at different radial angles with respect to each other with reference to the spin axis of the rotor. The holder also incorporates means for securely holding the tubes within the holder while they are being transported, so that the holder can be inverted without the escape of the tubes. On the other hand, the biasing or securing means for the tubes in the holder is eliminated when the holder is at rest on the workbench to permit convenient and easy insertion or removal of the centrifuge tubes. The tube holders act in conjunction with a spacer within the rotor bowl to not only provide the proper placement of the centrifuge tube holders during centrifugation, but also permit extraction of the holders from the rotor bowl to remove essentially all obstructions within the rotor bowl for easier cleaning after a centrifugation run.

12 Claims, 9 Drawing Figures

CENTRIFUGE TUBE HOLDER

BACKGROUND OF THE INVENTION

The present invention is directed to a centrifuge tube holder and, more particularly, is directed to a centrifuge tube holder which provides not only vertical support for the tubes when placed on a workbench, but also horizontal support for the tubes when placed in centrifuge rotor in such a manner that each of at least two tubes have different radial angles with respect the spin axis of the rotor.

In many cases the racks utilized for holding centrifuge tubes while placed on a table top or workbench have a different configuration than the frame utilized for supporting the centrifuge tubes within the rotor during centrifugation. These different configurations necessitate the physical removal of the tube from the tube rack to the support mechanism in the rotor. The movement of the centrifuge tubes especially after the centrifugation run has been completed is undesirable, because it is preferable to impart the least motion or disturbance to the centrifugated sample as possible. Otherwise, the disturbance to the centrifugated sample may be such that the sample may become remixed, rendering it unusable for the purpose intended.

Some prior art arrangements utilize a tube rack which is capable of placement directly in a centrifuge. However, in such case significant modification is necessary for the rotor structure to accommodate the tube rack. Therefore, the rotor must be specifically adapted to handle the particular tube rack construction.

Also, with the previously used types of centrifuge tube racks or holders that are placed in rotors, a separate rack is required for each row of centrifuge tubes to provide the necessary radial or angular orientation with respect to the spin axis in the case of a fixed horizontal tube motor. This results in a limitation in most instances of the number of centrifuge tubes that can be placed in the rotor in the horizontal orientation. Also, the apparatus within the rotor bowl for holding the centrifuge tubes is such that each time the centrifuge tubes are placed as a group in the various locations within the rotor, the rotor must be balanced prior to the centrifugation run. The apparatus within the bowl to support the tubes is typically quite complicated and in some instances is secured in a somewhat permanent basis within the rotor bowl. This causes a disadvantage in attempting to clean the interior of the bowl after centrifugation runs when a sample may possibly leak or spill from the tubes. The irregular shapes of the apparatus used to hold the tubes makes the cleaning of the interior of the bowl inefficient and time consuming.

One distinct disadvantage of most prior art centrifuge tube holders or racks is the tight fit into which the centrifuge tube is placed in the aperture or receptacle portion of the holder. This is required in order to hold the centrifuge tube securely within the rack or holder and prevent the loss of the tube from the rack if the tube holder or the rack is inverted. Therefore, because of this tight fit, the tube is difficult to insert and remove and may cause a jarring or disturbance to the centrifugated sample when trying to remove the tube containing the sample.

Quite often prior centrifuge tube racks or holders are somewhat complicated in design, requiring an expensive overall structure which is neither convenient to use nor economical to manufacture.

SUMMARY OF THE INVENTION

The present invention comprises two separate centrifuge tube holder sections that are pivotally connected in such a manner that the tubes are vertically supported when the holder is placed on a table top or workbench and horizontally supported when placed in a rotor. When placed in the rotor at least two of the tubes can be oriented at different radial angles with respect to each other in the direction of the spin axis of the rotor. The present holder provides the complete support for the centrifuge tube when placed in a rotor, so that no additional support apparatus is required for placement within the rotor during centrifugation of the sample carrying tubes.

The present tube holder incorporates a biasing or locking feature which automatically secures the tubes tightly within the holder when the two sections are held in such a manner that they are forced toward each other. When the sections are relaxed and not forced toward each other, the locking feature of the holding device releases its contact on the tubes and permits easier insertion and removal of the tubes from the holder. The apertures or slots within the holder designed to receive the tubes are made of sufficient size to permit the easy entrance and removal of the centrifuge tubes. The unique design of the tube holder is such that a maximum plurality of centrifuge tubes can be placed within a rotor of a given size.

Because of the locking feature in the tube holder, the present invention allows for the decanting of the tubes easily without rehandling them. In other words, it is not necessary to remove the tube for decanting if desirable. Also, in the present design, the two pivotal sections are frame-like members which have their end portions exposed to permit visual observation of the tubes being filled.

The present tube holder provides for at least two rows of centrifuge tubes in one holder which has a pivoting capability so that each row of test tubes is properly aligned with the force field. Other centrifuge tube holders having more than one row of tubes do not have each row properly aligned with the force field.

Once centrifugation is completed, the tube holders can be removed from the bowl rotor and allow for the efficient and easy cleaning of the interior of the bowl. This is very important with respect to the ability to efficiently use the centrifuge rotor which would require a minimum of time for cleaning between centrifugation runs when necessary.

DETAILED DESCRIPTION OF THE INVENTION

Figure 1:
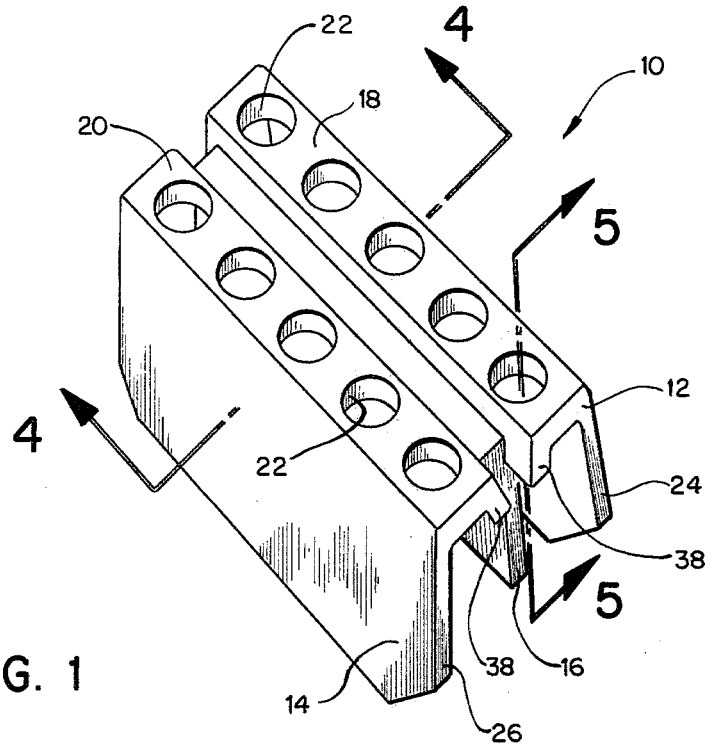
FIG. 1 is a perspective view of the present invention.
Figure 2:
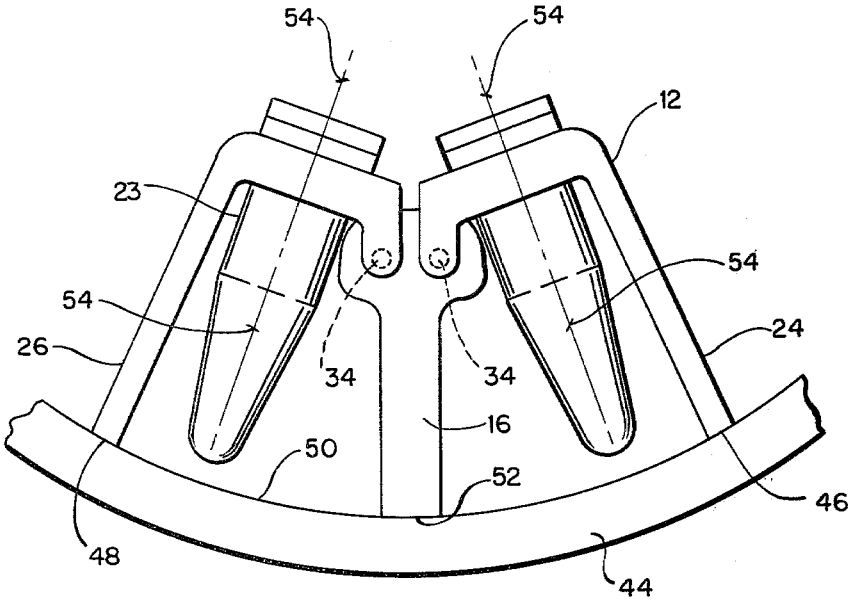
FIG. 2 is a top end view of the tube holder of the present invention placed in a rotor with the tubes oriented in a horizontal position with different radial angles.
Figure 3:
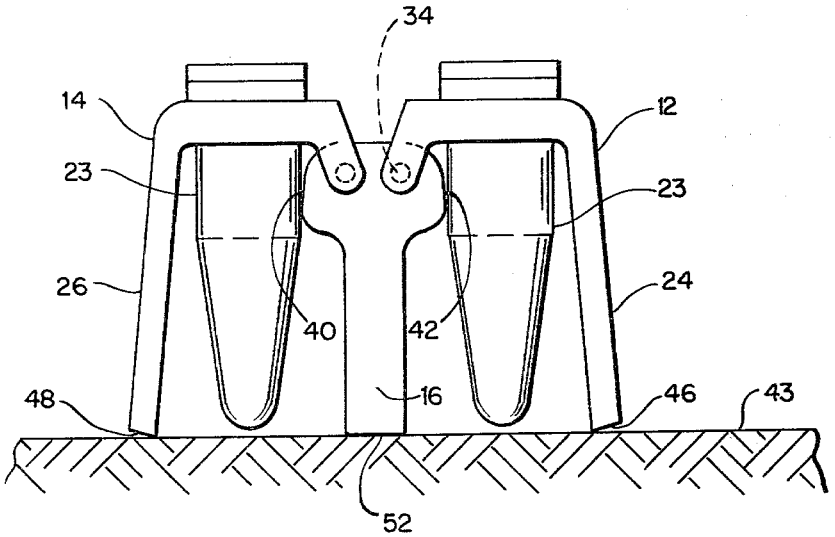
FIG. 3 is an end view of the tube holder supporting the tubes in a vertical orientation when placed on a workbench or flat surface.

The holder device 10 is shown in FIG. 1 having two pivotal tube support sections 12 and 14 which are mounted on a central support member 16. Each of the pivotal members 12 and 14 have a support surface 18 and 20, respectively, which contain tube holding apertures 22 into which centrifuge tubes 23 are placed, as shown in FIGS. 2 and 3. Also, the pivotal portions 12 and 14 have respective leg members 24 and 26 which provide support when the tube rack holder is placed on a workbench or placed in a centrifuge rotor.

Figure 4:
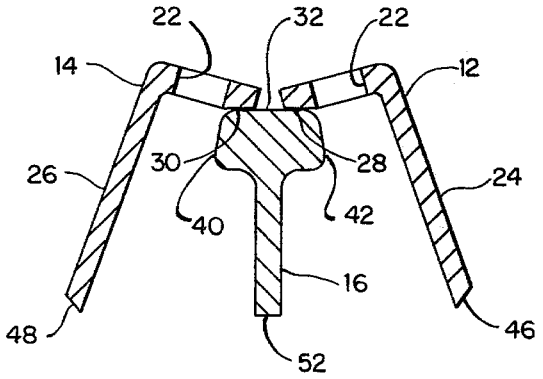
FIG. 4 is a sectional view taken along the lines 4—4 in FIG. 1.

As shown more clearly in FIG. 4, each of the pivoting support or receptacle portions 12 and 14 have slightly inclined bearing surfaces 28 and 30 which are designed to rest on the top curved surface 32 of the center support member 16 when the pivoting members 12 and 14 are pivoted outwardly as shown in FIG. 4. Therefore, the surfaces 28 and 30 will bear a significant amount of the forces of the pivot sections 12 and 14 during centrifugation. Consequently, the means for pivotally connecting the pivotal members 12 and 14 to the central support 16 will not have to bear a significant portion of the load during centrifugation.

Figure 5:
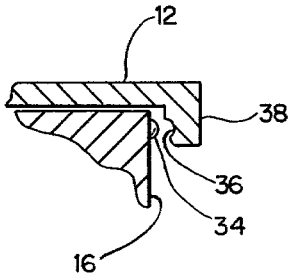
FIG. 5 is a partial sectional view taken along lines 5—5 in FIG. 1.

As shown in FIG. 5, one example of pivotally attaching each of the pivotal portions 12 and 14 to the central portion 16 could be the use of the detent arrangement having a spherical protruding portion 34 on the central support member 16 and a recessed mating portion or area 36 on the connecting arms 38 on each of the pivotal members 12 and 14. It should be noted, however, that other means could be utilized to provide the pivoting of the moving sections 12 and 14 to the central portion 16. These means could utilize a continuous bar throughout the length of the central section 16 or the use of pivoting bolts or screws, etc. The desirable use of the detent or snap type relationship of a spherical projection 34 and recess 36 as shown in FIG. 5 is that the holder sections which preferably will be molded out of high strength plastic can be snapped into and out of engagement with the central portion 16 to enable better cleaning of the holder as desired.

As shown in FIG. 3, when it is desirable to move the tube holder with tubes therein to a position for decanting, the movement of the support legs 24 and 26 toward each other results in the enlarged locking surfaces 40 and 42 on the central portion 16 contacting the tubes 23 and holding them secure within the holder device. Decanting is done in many instances to remove the unwanted solution and leave the centrifugated pellet in the bottom for analysis. Consequently, it is quite simple and expeditious to remove the solution from a plurality of centrifugated tubes in the tube holder for retaining of the pellet at the bottom of the tubes. The holding of the respective leg portions 24 and 26 of the pivoting sections 12 and 14 automatically will lock or hold the tubes in place when they are inverted because of the bumper or locking surfaces 40 and 42 on the central portion 16.

The unique arrangement of the present invention allows for the dual usage of the device. As shown in FIG. 3, the holder device 10 can be placed on a workbench or table top 43 with the support legs or portions 24 and 26 oriented in a somewhat parallel orientation with the central portion 16 to vertically support the centrifuge tubes. However, when it is desirable to centrifuge the centrifuge tubes, the entire device is placed within a centrifuge rotor 44 as shown in FIG. 2 wherein the bottom edges 46 and 48 of the support sections 12 and 14 contact the interior side surface 50 of the rotor 44. Also, the bottom edge 52 of the central member 16 is in contact with the interior side surface 50 of the rotor. Therefore, as shown in FIG. 2, the holder device is placed into the rotor on end so that the tubes will maintain or assume a horizontal orientation. During centrifugation all the leg portions 24 and 26 of the pivoting areas or portions 12 and 14 along with the central portion 16 provide support to the tubes during centrifugation.

In order to properly orient the tubes with respect to the spin axis of the rotor, the pivoting portions 12 and 14 are oriented as shown in FIG. 2 with a pivot of approximately 15° with respect to the longitudinal center lines 54 of the centrifuge tubes 23. This permits each of the tubes to be properly oriented with the spin axis and force field during centrifugation. As previously discussed with respect to FIG. 4, the bearing surfaces 28 and 30 of the support portions 12 and 14 on the central support will assume a significant amount of the load, reducing the forces on the pivotal connections between the pivoting sections 12 and 14 of the support member 16.

Figure 7:
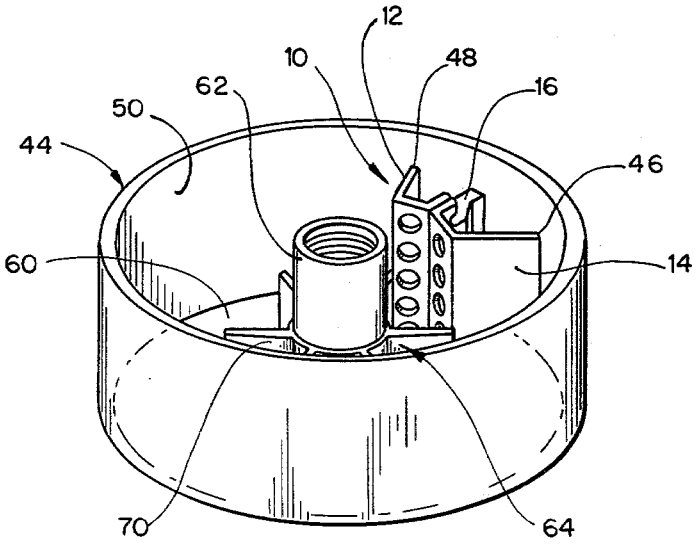
FIG. 7 shows a tube holder in position within the rotor bowl.

The general configuration of the rotor 44 is shown in FIG. 7 having essentially a bowl shape or hollow interior into which the holder devices 10 are placed. As previously explained with respect to FIG. 2, the bottom edges 46 and 48 of the support sections 12 and 14 contact the interior side surface 50 of the rotor. The interior of the rotor is essentially smooth on its side interior surface 50. At the center of the rotor is a connection post 62 into which a cover, not shown, is secured after the insertion and balancing of the holder members 10 with the centrifuge tubes. This cover is necessary in order to provide a smooth exterior surface to the rotor to eliminate potential air friction which would otherwise occur during the operation of the rotor.

Figure 6:
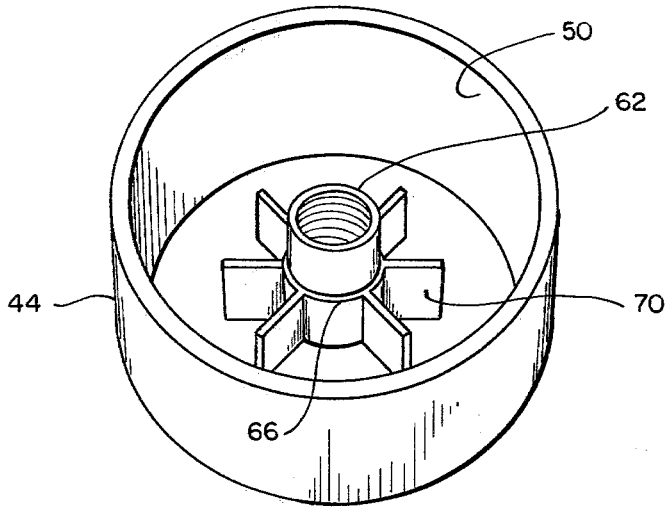
FIG. 6 is a typical bowl type of rotor into which the present invention components are placed.

In order to properly position the plurality of tube holders 10 within the rotor 44, a support member or spacer 64 as shown in FIG. 6 is mounted on the center post 62 in the interior of the rotor. The spacer 64 has a central ring portion 66 designed to receive the center post 62 of the rotor. Extending from the center ring portion 66 are a plurality of divider members 70 which are designed to position and properly space the tube holders within the bowl rotor 44 of FIG. 6.

Reference is made to FIG. 7 showing the spacer 64 within the bowl rotor 44 with a single tube holder 10 showing its general orientation with respect to the interior side surface 50 of the rotor 44. For operational purposes a balanced number of tube holders have to be placed within the rotor to provide the proper operation of the rotor. The spacer divider members 70 provide the proper orientation and placement of each of the tube holders in a properly balanced corresponding location around the circumference of the rotor 44.

Once centrifugation has been completed, the entire holder assembly 10 can be removed from the rotor 44 and placed on a workbench 43 shown in FIG. 3 wherein the holder acts as a support means for the tubes subsequent to centrifugation. Also, it may be desirable to decant the solution from each of the tubes and to leave the remaining pellet for later analysis. By simply grasping the pivoting sections 12 and 14 and moving them toward each other, the locking or bearing surfaces 40 and 42 on the central portion will hold the tubes secure within the holder and allow for the inversion of the holder to remove the unwanted solution.

After all of the tube holders have been removed from the centrifuge bowl rotor 44, the interior of the bowl rotor is essentially smooth and free of any projections, except for the spacer so that any necessary cleaning of the interior of the rotor can be accomplished with ease. Typically, it is necessary in the case of any possible leakage of one of the tube samples that the interior be cleansed before the next centrifugation run.

Figure 8:
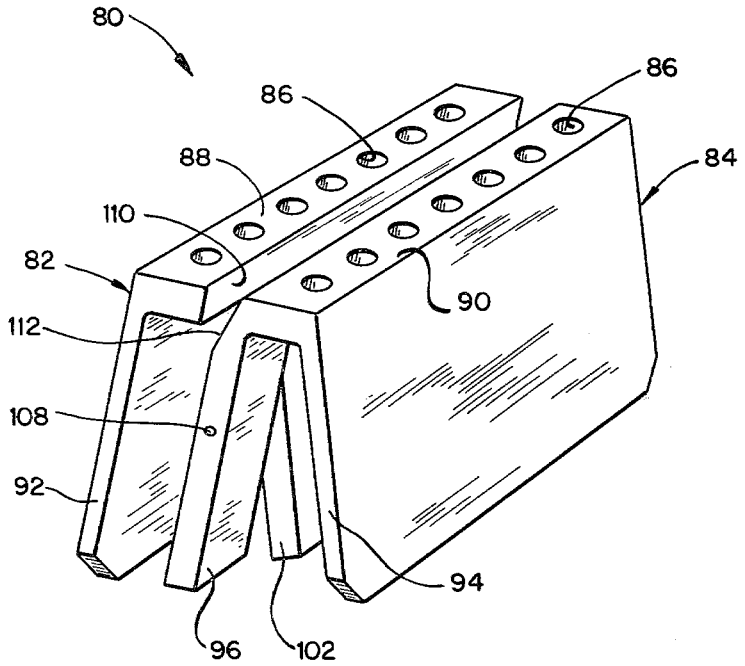
FIG. 8 is a top perspective view of an alternate embodiment of the present invention.

An alternate embodiment 80 of the present invention is shown in FIG. 8 having two pivotal tube support sections 82 and 84 which are pivotally connected to each other in a manner which will be described in more detail below. Each of the tube support sections has a plurality of apertures 86 which are designed to receive centrifuge tubes. Each of the support sections 82 and 84 have a support surface 88 and 90 respectively in which are located the apertures 86. Each of the support sections have a support leg 92 and 94 respectively which provide support for the holder device when it is used as a support for test tubes in a vertical orientation on a working table or when placed in a rotor. It should be noted that the holder device 80 operates with respect to support for centrifuge tubes in both the rotor and on a working table in the same manner as described previously with respect to holder device 10.

Figure 9:
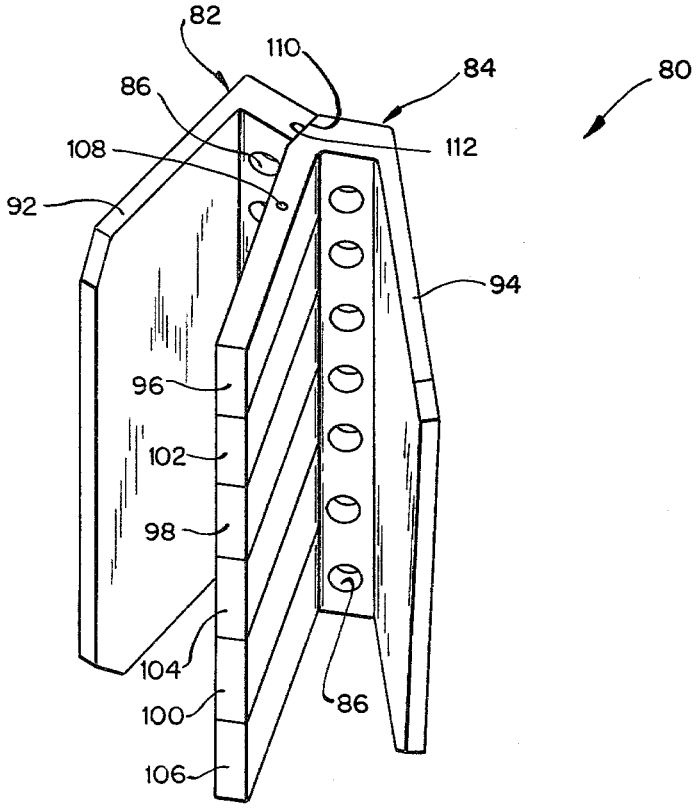
FIG. 9 is a bottom perspective view of an alternate embodiment of the present invention.

As shown more clearly in FIG. 9, the support section 84 has a plurality of center legs or posts 96, 98 and 100 which are integrally formed with the support section 84. Similarly, support section 82 has the center legs or supports 102, 104 and 106. Consequently, the legs from each of the respective sections are oriented in alternating sequence along the longitudinal length of the holder to form the center support for the holder device 80. When the holder device 80 is placed within the rotor in a manner similar as shown in FIG. 2 for the holder device 10, the plurality of center legs or supports 96–106 perform the same function as the center post 16 in the holder device 10. In other words, when in the rotor, the holder device 80 receives support in its center section from the center legs 96–106. Also, it should be noted that all of the legs 96–106 are lined in side-by-side relation with their surfaces in alignment as shown in FIG. 9 when placed within the rotor in an orientation as shown in FIG. 2 for the holder device 10.

The support sections 82 and 84 are pivotally connected together by two pivoting pins. One of the pins 108 is connected between the support legs 96 of the section 84 and leg 102 of section 82. Another pin not shown is pivotally connected between the leg 106 of section 82 and leg 100 of section 84. Consequently, as shown in FIG. 8, the respective sections 84 and 82 can be pivoted so that, for instance, the legs 96 and 102 are at an angle to each other. When the holder device 80 is used as a support for the tubes in a vertical direction as shown for the holder device 10 in FIG. 3, the support legs of the section 82 and the support legs of the section 84 are at an angle to each other in the manner similar shown with respect to legs 96 and 102. The center legs 96–106, as well as the side legs 92 and 94, provide support to the holder device when the holder device 80 is oriented or placed on a table for vertical support of the tubes.

It should be noted that the pivoting support section 82 has a central support surface 110 which is designed to mate with the central support surface 112 of the support section 84. Therefore, when the holder 80 is placed within the centrifuge rotor, the surfaces 110 and 112 are in contact with each other to provide support as shown in FIG. 9.

It is envisioned that a similar type of centrifuge tube holder could be made from other various specific configurations while still encompassing the primary concept of the present invention. Any number of holes or apertures for test tubes could be placed within each of the holders depending upon the size of the holders constructed.

What is claimed is:

1. A centrifuge tube holder comprising:

a first section for holding at least one centrifuge tube;

a second section for holding at least one centrifuge tube, each of said first and second sections having a support leg;

a central support post; and means for pivotally connecting said first and second sections to allow respective movement between said first and second sections, the bottom edges of said central post, said first section support leg and said second section support leg being positionable in the same general horizontal plane, so that said support legs of said first and second sections with said central support post will support said tubes vertically on a workbench, said bottom edges of said central post, said first section support leg and said second section support leg being positionable in general alignment with a concave cylindrical surface so that said support legs and said central post will hold said tubes horizontally in a rotor with said tubes having different radial orientations with respect to the spin axis of said rotor.

2. A centrifuge tube holder as defined in claim 1, wherein each of said first and second sections comprises a receptacle portion attached to the support leg, said receptacle portion having at least one aperture for receipt of a centrifuge tube.

3. A centrifuge tube holder as defined in claim 1 and additionally comprising means on one of said central support post and said section for locking said centrifuge tubes within said holder when said first and second sections are pivoted toward each other.

4. A centrifuge tube holder as defined in claim 3, wherein said locking means comprises a locking surface which contacts the side of said centrifuge tubes.

5. A centrifuge tube holder as defined in claim 1, wherein each of said first and second sections has a contact face for engagement with said central support member to establish the radial orientation of said centrifuge tubes when said first and second sections are pivoted away from each other and placed in a rotor for centrifugation, said contact faces in conjunction with said central support member providing support to said first and second sections during centrifugation.

6. A centrifuge tube holder as defined in claim 1, wherein said pivotal connecting means for said first and second sections to said support post comprises a pivot pin.

7. A centrifuge tube holder comprising:

a first section having at least one aperture for receiving a centrifuge tube;

a second section having at least one aperture for receiving a centrifuge tube;

a central post member, each of said first section, second section and central post having a bottom edge; and means for pivotally connecting said sections to opposite sides of said post member, said sections movable between a first position and a second position, said sections in said first position holding said tubes vertically when said bottom edges of said holder are in contact with a worktable, said sections in said second position supporting said tubes horizontally in a rotor with said tube of said first section having a different radial orientation than said tube of said second section with respect to the spin axis of said rotor when said bottom edges of said holder are in contact with the interior cylindrical side surface of said rotor.

8. A centrifuge tube holder comprising:

a first section for receipt of at least one centrifuge tube;

a second section for receipt of at least one centrifuge tube;

means for connecting said first and second sections; and means on said connecting means for maintaining said tubes secure in said section when said holder is carried and for automatically releasing said secure hold on said tubes when said holder is resting on a table to allow easy insertion and removal of said tubes.

9. A centrifuge rotor comprising:

a bowl portion with a generally smooth interior cylindrical side wall and a generally smooth interior bottom surface;

a plurality of holder means positioned with said bowl portion, each of said holder means having at least two pivotal tube sections for carrying at least one tube in each section, said holder means positioning said tube of one section at a different radial orientation than the tube of the other section with respect to the spin axis of said rotor, said holder means also holding said tubes in a vertical orientation on a workbench when removed from said rotor; and means mounted in said rotor for positioning each of said holder means within said rotor in a properly balanced position.

10. A centrifuge rotor as defined in claim 9, wherein said positioning means comprises a plurality of equally spaced divider members extending radially in a horizontal direction from the axial center of said rotor.

11. A centrifuge tube holder comprising:

a first section for holding at least one centrifuge tube, said first section having a side support leg and a plurality of central legs;

a second section for holding at least one centrifuge tube, said second section having a side support leg and a plurality of central legs; and means for pivotally connecting said plurality of central legs of said first and second sections, said central legs of said first and second sections being arranged in an alternating side by side orientation along the longitudinal length of said tube holder.

12. A centrifuge tube holder as defined in claim 11, wherein said central legs are oriented on said first and second sections in such a manner that, when said holder supports said tube in a vertical direction, said central legs are aligned along a common plane, said central legs of said first section being at an angle to said central legs of said second section when said holder supports said tube in a horizontal direction within a rotor.

* * * * *